US008263297B2

(12) United States Patent
Ikegami et al.

(10) Patent No.: US 8,263,297 B2
(45) Date of Patent: Sep. 11, 2012

(54) ELECTROPHOTOGRAPHIC PHOTOCONDUCTOR AND ELECTROPHOTOGRAPHIC APPARATUS

(75) Inventors: Takaaki Ikegami, Susono (JP); Takeshi Takada, Yokohama (JP); Toshihiko Koizumi, Kofu (JP); Hideki Nakamura, Kofu (JP); Hajime Suzuki, Kofu (JP); Keisuke Shimoyama, Numazu (JP); Kohsuke Yamamoto, Numazu (JP); Eiji Kurimoto, Numazu (JP)

(73) Assignees: Ricoh Company, Ltd., Tokyo (JP); Yamanashi Electronics Co., Ltd., Yamanashi (JP)

( * ) Notice: Subject to any disclaimer, the term of this patent is extended or adjusted under 35 U.S.C. 154(b) by 554 days.

(21) Appl. No.: 12/323,096

(22) Filed: Nov. 25, 2008

(65) Prior Publication Data

US 2009/0136260 A1 May 28, 2009

(30) Foreign Application Priority Data

Nov. 28, 2007 (JP) ..... 2007-307464
Sep. 30, 2008 (JP) ..... 2008-252314

(51) Int. Cl.
*G03G 5/047* (2006.01)
*G03G 5/06* (2006.01)

(52) U.S. Cl. ..... 430/58.85; 430/59.2; 430/72; 430/73; 399/159

(58) Field of Classification Search ..... 430/59.2, 430/58.85, 72, 73; 399/159
See application file for complete search history.

(56) References Cited

U.S. PATENT DOCUMENTS 4,606,988 A * 8/1986 Sasaki ..... 430/58.75
5,567,560 A * 10/1996 Hagiwara et al. ..... 430/58.85
5,578,405 A 11/1996 Ikegami et al.
6,861,188 B2 3/2005 Ikegami et al.
7,018,755 B2 3/2006 Ikegami et al.
7,112,392 B2 9/2006 Shimada et al.
7,212,777 B2 5/2007 Takada et
7,267,916 B2 9/2007 Sugino et al.
7,314,693 B2 1/2008 Ikegami et al.
7,381,511 B2 6/2008 Ikegami et al.
7,391,994 B2 6/2008 Ikegami et al.
7,629,096 B2 * 12/2009 Suzuki et al. ..... 430/58.85
2005/0058918 A1 3/2005 Kurimoto et al.
2006/0141378 A1 6/2006 Takada et al.
2006/0199092 A1 9/2006 Sugino et al.
2007/0015074 A1 1/2007 Sugino et al.
2007/0059618 A1 3/2007 Kurimoto et al.
2007/0117033 A1 5/2007 Sugino et al.
2007/0231733 A1 10/2007 Takada et al.
2007/0287083 A1 12/2007 Gondoh et al.
2009/0004585 A1 1/2009 Suzuki et al.
2009/0325092 A1 * 12/2009 Wu ..... 430/58.8

FOREIGN PATENT DOCUMENTS

CN 1655066 A 8/2005
JP 60-175052 9/1985
JP 62-120346 6/1987
JP 1-106069 4/1989
JP 4-37762 2/1992
JP 05165241 A * 7/1993
JP 05257304 A * 10/1993
JP 05333570 A * 12/1993
JP 07140693 A * 6/1995
JP 2951031 7/1999
JP 2000-147807 5/2000
JP 3147406 1/2001
JP 3181799 4/2001
JP 3412348 3/2003
JP 2004037766 A * 2/2004
WO WO 2006003897 A1 * 1/2006
WO WO 2007/088770 A1 8/2007

OTHER PUBLICATIONS

English language machine translation of JP 05-257304 (Oct. 1993).*
English language machine translation of JP 05-333570 (Dec. 1993).*
English language machine translation of JP 07-140693 (Jun. 1995).*
English language machine translation of WO 2006/003897 (Jan. 2006).*
Diamond, Arthur S & David Weiss (eds.) Handbook of Imaging Materials, 2nd ed.. New York: Marcel-Dekker, Inc. (Nov. 2001) pp. 164-168.*
Diamond, Arthur S & David Weiss (eds.) Handbook of Imaging Materials, 2nd ed.. New York: Marcel-Dekker, Inc. (Nov. 2001) pp. 145-164.*
Dec. 31, 2011 Chinese official action (with English translation) in connection with a counterpart Chinese patent application.

* cited by examiner

*Primary Examiner* — Christopher Rodee
(74) *Attorney, Agent, or Firm* — Cooper & Dunham LLP

(57) ABSTRACT

An electrophotographic photoconductor including a conductive support and a photosensitive layer, wherein the photosensitive layer contains a charge generation agent, a charge transport agent and a binder resin, and wherein the charge generation agent contains an asymmetric disazo pigment represented by General Formula (I), the charge transport agent contains a triphenylamine compound represented General Formula (IX), and the mass ratio of the charge transport agent to the binder resin is 0.3 to 2.0, General Formula (I)

where $R_1$ and $R_2$ each represent a substituted or unsubstituted alkyl group, alkoxy group, aryl group or heterocyclic group, provided that $R_1$ and $R_2$ are different, General Formula (IX)

where $R_3$ to $R_5$ each represent hydrogen, a halogen atom, an alkyl group having 1 to 6 carbon atoms, which may have a substituent, an alkoxy group having 1 to 6 carbon atoms, which may have a substituent, or a substituted or unsubstituted aryl group having 6 to 12 carbon atoms.

16 Claims, 2 Drawing Sheets

ELECTROPHOTOGRAPHIC PHOTOCONDUCTOR AND ELECTROPHOTOGRAPHIC APPARATUS

BACKGROUND

1. Technical Field of the Invention

This disclosure relates to an electrophotographic photoconductor containing a specific disazo pigment serving as a charge generation agent, a specific triphenylamine compound serving as a charge transport agent, and a binder resin, wherein the ratio of the charge transport agent to the binder resin falls within a suitable range.

2. Description of the Related Art

In recent years, long-wavelength light sources (e.g., laser diode and LED) are mostly used as an exposing source in non-impact printers employing electrophotography. In addition, with downsizing and speeding-up of copiers and printers, smaller photoconductors and high-speed processes have been employed. Thus, electrophotographic photoconductors generally include a charge generation agent sensitive to long-wavelength light. Conventionally, phthalocyanine pigments are often used as a material serving as such a charge generation agent. The phthalocyanine pigments are well known to exhibit different sensitivities depending on different crystal types. Furthermore, exposing sources used in electrophotographic apparatuses (e.g., printers) are required to be reduced in its power output for meeting the recent requirements (e.g., power saving). In view of this, keen demand has arisen for electrophotographic photoconductors with higher sensitivity.

Oxytitanium phthalocyanine is one of the phthalocyanine pigments highly sensitive to long-wavelength light of about 780 nm. In particular, oxytitanium phthalocyanine having a maximum diffraction peak of 27.2° is thought to be highly sensitive. When repeatedly used in a high-speed process, the photoconductor containing this oxytitanium phthalocyanine exhibits degraded potential characteristics, resulting in causing fogging, black streaks, density unevenness, etc. in the formed image. In a normal electrophotographic process, such high-sensitive oxytitanium phthalocyanine exhibits advantageous effects (e.g., highly sensitive responsiveness) since it generates a relatively large amount of charges; but in a high-speed electrophotographic process, excessive charges generated therefrom undesirably remain in the photosensitive layer to cause a memory residue on the photoconductor surface, resulting in that the memory residue is developed to form an unnecessary image at the subsequent electrophotographic processes. Furthermore, the charges are undesirably retained in the photosensitive layer under any working conditions (i.e., low-temperature, low-humidity conditions to high-temperature, high-humidity conditions). Recent interest has focused on an azo pigment sensitive to light with a wavelength of about 650 nm. The type thereof must be carefully determined in consideration of charge-transport performance of a charge transport agent used in combination (see, for example, Japanese Patent Application Laid-Open (JP-A) No. 2000-147807).

Under such circumstances, there has been demand for an electrophotographic photoconductor which is highly sensitive to long-wavelength light and which exhibits reliable electrophotographic characteristics even after repeatedly used (in particular, reliable chargeability at an initial state and after repetitive use). Meanwhile, even in use of a charge generation agent exhibiting high charge generation efficiency, when it is used together with a charge transport agent that is not effectively used in combination, the formed photoconductor cannot only exhibit sufficient sensitivity but also provide a high-quality image under any working conditions (i.e., low-temperature, low-humidity conditions to high-temperature, high-humidity conditions). Although studies have been carried out from various aspects on an effective combination of a charge generation agent and a charge transport agent, there is still room for research on it (see, for example, JP-A No. 60-175052).

SUMMARY

In an aspect of this disclosure, there is provided an electrophotographic photoconductor which can be downsized and used in a high-speed process so that it can be used in the resent downsized, high-speed copiers and printers; which is highly sensitive to long-wavelength light; and whose electrical characteristics are not degraded and highly reliable even after repetitive use.

In another aspect, it was determined through extensive studies that it is advantageous to utilize an electrophotographic photoconductor containing a specific asymmetric disazo pigment serving as a charge generation agent and a specific triphenylamine compound serving as a charge transport agent.

Various other aspects, features and advantages are described herein, such as, for example, the following:

<1> An electrophotographic photoconductor including:

a conductive support, and a photosensitive layer formed over the conductive support, wherein the photosensitive layer contains a charge generation agent, a charge transport agent and a binder resin, and wherein the charge generation agent contains an asymmetric disazo pigment represented by the following General Formula (I), the charge transport agent contains a triphenylamine compound represented by the following General Formula (IX), and the ratio of the charge transport agent to the binder resin is 0.3 to 2.0, General Formula (I)

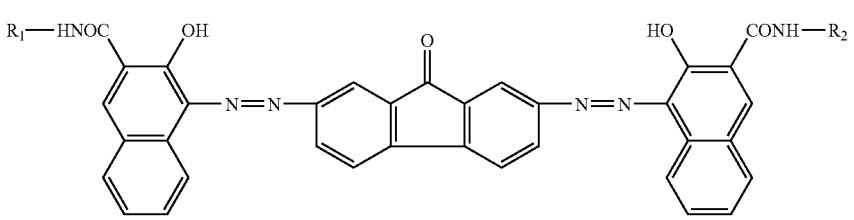

where $R_1$ and $R_2$ each represent a substituted or unsubstituted alkyl group, alkoxy group, aryl group or heterocyclic group, provided that $R_1$ and $R_2$ are different, General Formula (IX)

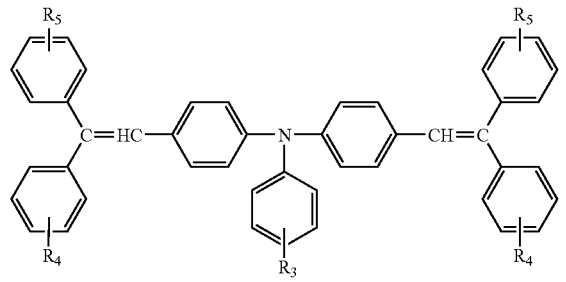

where $R_3$ to $R_5$ each represent hydrogen, a halogen atom, an alkyl group having 1 to 6 carbon atoms, which may have a substituent, an alkoxy group having 1 to 6 carbon atoms, which may have a substituent, or a substituted or unsubstituted aryl group having 6 to 12 carbon atoms.

<2> The electrophotographic photoconductor according to <1> above, wherein the charge transport agent contains a compound having the following Structural Formula (IXa).

Structural Formula (IXa)

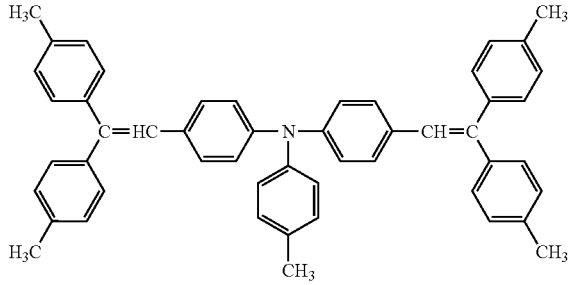

<3> The electrophotographic photoconductor according to <1> above, wherein the charge transport agent contains a compound having the following Structural Formula (IXb).

Structural Formula (IXb)

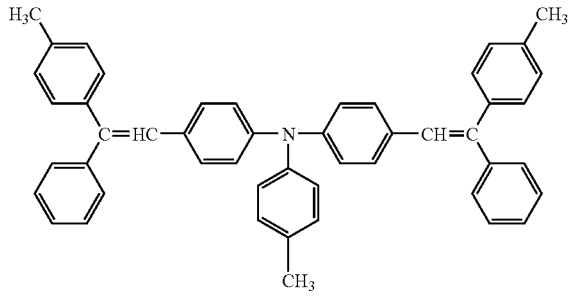

<4> The electrophotographic photoconductor according to <1> above, wherein the charge transport agent contains a compound having the following Structural Formula (IXc).

Structural Formula (IXc)

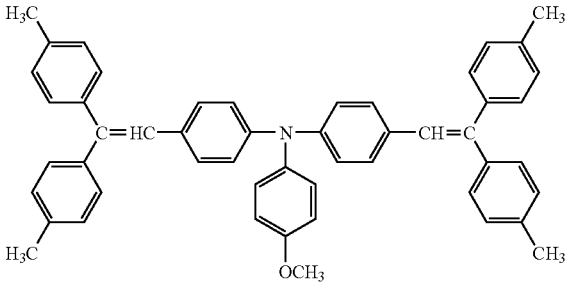

<5> The electrophotographic photoconductor according to <1> above, wherein the charge transport agent contains a compound having the following Structural Formula (IXd).

Structural Formula (IXd)

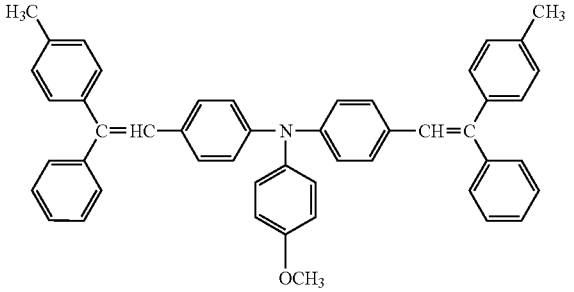

<6> The electrophotographic photoconductor according to <1> above, wherein the electrophotographic photoconductor contains two charge transport agents selected from a charge transport agent having the Structural Formula (IXa), a charge transport agent having the Structural Formula (IXb), a charge transport agent having the Structural Formula (IXc) and a charge transport agent having the Structural Formula (IXd).

<7> The electrophotographic photoconductor according to <1> above, wherein the photosensitive layer contains a charge generation layer and a charge transport layer.

<8> The electrophotographic photoconductor according to <1> above, wherein the charge transport layer contains a benzotriazole-based UV ray absorber.

<9> The electrophotographic photoconductor according to <1> above, wherein the charge transport layer contains an amine-based antioxidant.

<10> An electrophotographic apparatus including:

a charging unit, an exposing unit, a developing unit, a transfer unit, and the electrophotographic photoconductor according to any one of <1> to <9> above.

<11> A digital electrophotographic apparatus including:

a charging unit, an exposing unit, a developing unit, a transfer unit, and the electrophotographic photoconductor according to any one of <1> to <9> above, wherein an electrostatic latent image is written on the electrophotographic photoconductor using an LD or LED as the exposing unit.

<12> The electrophotographic apparatus according to any one of <10> and <11> above, wherein the electrophotographic apparatus is a tandem electrophotographic apparatus including a plurality of electrophotographic photoconductors, charging units, developing units and transfer units.

<13> The electrophotographic apparatus according to any one of <10> and <11> above, further including an intermediate transfer unit configured to primarily transfer a toner image developed on the electrophotographic photoconductor onto an intermediate transfer member and secondarily transfer the toner image onto a recording medium, wherein toner images of a plurality of colors are sequentially superimposed on the intermediate transfer member to form a color image and then the color image is secondarily transferred at one time onto the recording medium.

<14> An electrophotographic process cartridge including:

at least one of a charging unit, an exposing unit, a developing unit, a cleaning unit and a transfer unit, and the electrophotographic photoconductor according to any one of <1> to <9> above.

As is clear from the difference in characteristics between Examples and Comparative Examples discussed herein, an electrophotographic photoconductor configured in a manner discussed herein can provide reliable performance during repetitive use and thus meet strict requirements of the market.

DETAILED DESCRIPTION OF THE INVENTION

Figure 1:
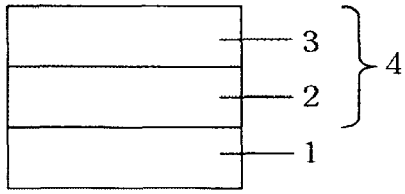
FIG. 1 is a cross-sectional view of an electrophotographic photoconductor of the present invention.

Referring now to the drawings, next will be described a preferred embodiment of an electrophotographic photoconductor according to the present invention. FIG. 1 exemplarily illustrates the structure of the electrophotographic photoconductor of the present invention. This structure is that of a functionally-separated electrophotographic photoconductor and is formed of a conductive support (1), a charge generation layer (2) containing at least a charge generation agent, and a charge transport layer (3) containing at least a charge transport agent, wherein the charge generation layer (2) is formed on the conductive support (1) and the charge transport layer (3) is formed on the charge generation layer (2). In this structure, a photosensitive layer (4) is formed of the charge generation layer and the charge transport layer.

The charge generation layer can be formed with any of various forming methods. In one forming method, a disazo pigment serving as the charge generation agent is dispersed or dissolved in an appropriate solvent together with a binder resin to prepare a coating liquid, and the thus-prepared coating liquid is applied onto a predetermined support serving as a base, followed by optional drying.

The charge transport layer contains at least a charge transport agent described below and can be formed by, for example, applying the charge transport agent with a binder resin onto the charge generation layer which serves as a base layer thereof.

The charge transport layer can be formed with any of various forming methods. In a commonly used forming method, a charge transport agent is dispersed or dissolved in an appropriate solvent together with a binder resin to prepare a coating liquid, and the thus-prepared coating liquid is applied onto the charge generation layer which serves as a base layer thereof, followed by optional drying.

Also, the electrophotographic photoconductor of the present invention may be an inverted bilayer electrophotographic photoconductor, in which a charge generation layer is formed above a charge transport layer, or a single-layer electrophotographic photoconductor containing a charge generation agent and a charge transport agent in a mixed state. If necessary, an intermediate layer may be formed between the conductive support and the charge generation layer, and further, a protective layer may be formed on the photosensitive layer.

Examples of the conductive support which can be used in the present invention include processed products of metals and alloys thereof (e.g., aluminum, brass, stainless steel, nickel, chromium, titanium, gold, silver, copper, tin, platinum, molybdenum and indium). The conductive support may have any flexible shape (e.g. sheet, film and belt) and may be endless. The diameter of the conductive support is preferably 60 mm or less, particularly preferably 30 mm or less.

Among them, aluminum alloys of JIS 3000 series, JIS 5000 series, JIS 6000 series, etc., are preferably used for the conductive support. This is formed by, for example, molding such an aluminum alloy with any of generally used methods (e.g., extrusion ironing (EI), extrusion drawing (ED), drawing ironing (DI) and impact ironing (II)). Additionally, the formed conductive support may be subjected to surface treatments (e.g., anodizing and polishing) and/or surface lathing with a diamond bite or other tools. Alternatively, it may not be subjected to such treatments; i.e., may be a tube having undergone no surface lathing.

In addition, the conductive support may be made of conductive resin or of resin into which a conductive agent (e.g. metal powder and conductive carbon) has been incorporated.

Furthermore, the conductive support may be a glass substrate whose surface has been covered with tin oxide, indium oxide or aluminum iodide for imparting conductivity thereto.

As mentioned above, the conductive support may have an intermediate layer thereon. This intermediate layer has functions of, for example, improving adhesiveness between the layers, preventing leak current from an aluminum tube (barrier function), and covering defects formed in/on the surface of an aluminum tube. The intermediate layer may be made of, for example, polyethylene resin, acrylic resin, epoxy resin, polycarbonate resin, polyurethane resin, vinyl chloride resin, vinyl acetate resin, polyvinyl butyral resin, polyamide resin, nylon resin, alkyd resin or melamine resin. These resins may be used alone or in combination. Also, metal compounds, carbon, silica, resin powder, etc. may be dispersed in the layer. Furthermore, various pigments, electron-accepting/donating compounds, etc. may be incorporated thereinto for improving its characteristics.

Similar to the photosensitive layer, the intermediate layer may be formed by using an appropriate solvent for dispersion and an appropriate coating method. The thickness thereof is preferably 0.1 μm to 50 μm, more preferably 0.5 μm to 20 μm.

The charge generation agent used in the present invention is an asymmetric disazo pigment represented by General Formula (I). Table 1 shows specific groups represented by $R_1$ and $R_2$ constituting the asymmetric disazo pigment. Note that $R_1$ and $R_2$ are different.

TABLE 1

| No. | $R_1/R_2$ |
|---|---|
| 1 | phenyl |
| 2 | 2-chlorophenyl |
| 3 | 3-chlorophenyl |
| 4 | 4-chlorophenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-pyrazolyl |
| 24 | 2-thiazolyl |
| 25 | 4-carboxyl-2-thiazolyl |
| 26 | 2-pyridyl |
| 27 | 2-pyrimidyl |
| 28 | 2-carbazolyl |
| 29 | 2-quinolyl |

In order to be sensitive to light with a suitable wavelength and to be effectively sensitized, the photosensitive layer may contain, together with the disazo pigment used in the present invention, another azo pigment (e.g., a monoazo pigment, a bisazo pigment, a trisazo pigment and a polyazo pigment), an indigo pigment, a slen pigment, a toluidine pigment, a pyrazoline pigment, a perylene pigment, a quinacridone pigment, a phthalocyanine pigment, a pyrylium salt, etc. Among them, a phthalocyanine pigment and a perylene pigment are preferably used in combination with the disazo pigment in terms of sensitivity.

Examples of the binder resin used for forming the photosensitive layer include polycarbonate resins, styrene resins, acrylic resins, styrene-acrylic resins, ethylene-vinyl acetate resins, polypropylene resins, vinyl chloride resins, chlorinated polyethers, vinyl chloride-vinyl acetate resins, polyester resins, furan resins, nitrile resins, alkyd resins, polyacetal resins, polymethylpentene resins, polyamide resins, polyurethane resins, epoxy resins, polyarylate resins, diarylate resins, polysulfone resins, polyethersulfone resins, polyallylsulfone resins, silicone resins, ketone resins, polyvinyl butyral resins, polyether resins, phenol resins, ethylene-vinyl acetate (EVA) resins, acrylonitrile-chlorinated polyethylene-styrene (ACS) resins, acrylonitrile-butadiene-styrene (ABS) resins and epoxy arylate resins.

These resins may be used alone or in combination. Use of two or more resins with different molecular weights is preferred, since the photosensitive layer can be provided with improved hardness and abrasion resistance.

Notably, when the photosensitive layer is formed of the charge generation layer and the charge transport layer, the above-listed resin may be used for forming any of these layers.

The amount of the binder resin is preferably 10 parts by mass to 500 parts by mass, more preferably 25 parts by mass to 300 parts by mass, per 100 parts by mass of the charge generation agent.

The thickness of the charge generation layer is 0.01 μm to 5 μm, preferably 0.1 μm to 2 μm.

The coating liquid therefore may be applied by, for example, dip coating, spray coating, ring coating, bar coating or spinner coating.

Examples of solvents used for forming the coating liquid include alcohols such as methanol, ethanol, n-propanol, i-propanol and butanol; saturated aliphatic hydrocarbons such as pentane, hexane, heptane, octane, cyclohexane and cycloheptane; aromatic hydrocarbons such as toluene and xylene; chlorine-containing hydrocarbons such as dichloromethane, dichloroethane, chloroform and chlorobenzene; ethers such as dimethyl ether, diethyl ether, tetrahydrofuran (THF), methoxyethanol, dioxolane, dioxan and anisol; ketones such as acetone, methyl ethyl ketone, methyl isobutyl ketone and cyclohexanone; esters such as ethyl formate, propyl formate, methyl acetate, ethyl acetate, propyl acetate, butyl acetate and methyl propionate; N,N-dimethylformamide; and dimethylsulfoxide. Among them, ketone solvents, ester solvents, ether solvents and halo-hydrocarbon solvents are preferred. These solvents may be used alone or in combination.

The electrophotographic photoconductor of the present invention contains, as a charge transport agent, a compound represented by the following General Formula (IX):

General Formula (IX)

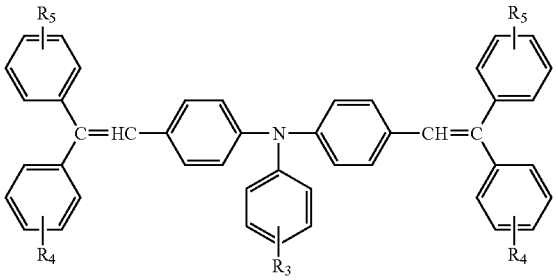

where $R_3$ to $R_5$ each represent hydrogen, a halogen atom, an alkyl group having 1 to 6 carbon atoms, which may have a substituent, an alkoxy group having 1 to 6 carbon atoms, which may have a substituent, or a substituted or unsubstituted aryl group having 6 to 12 carbon atoms.

The above charge transport agent can be effectively used in combination with the disazo pigment used in the present invention and thus, use of them can provide an electrophotographic photoconductor having excellent environmental stability.

Among the compounds represented by the above General Formula (IX), a charge transport agent selected from the group consisting of compounds with the following Structural Formulas (IXa) to (IXd) is preferred, since it can be effectively used in combination is with the disazo pigment used in the present invention.

Next, the compounds with the Structural Formulas (IXa) to (IXd) will be given. However, the charge transport agent is not limited thereto.

Structural Formula (IXa)

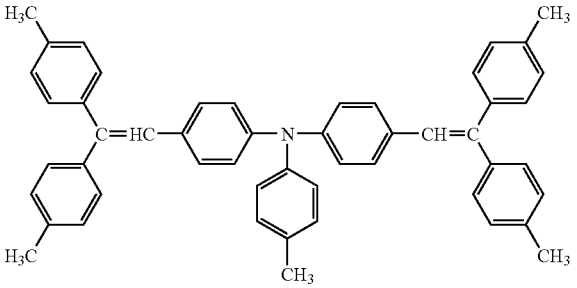

Structural Formula (IXb)

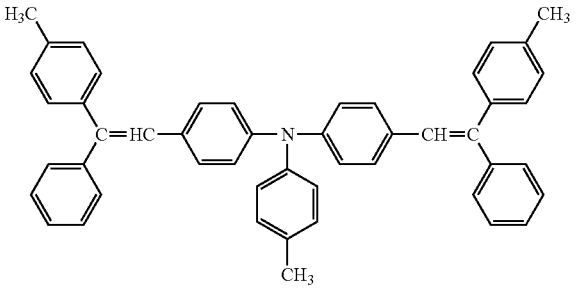

Structural Formula (IXc)

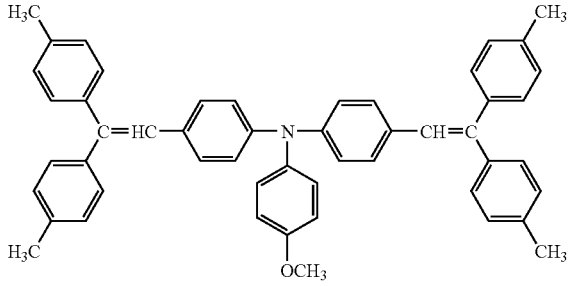

Structural Formula (IXd)

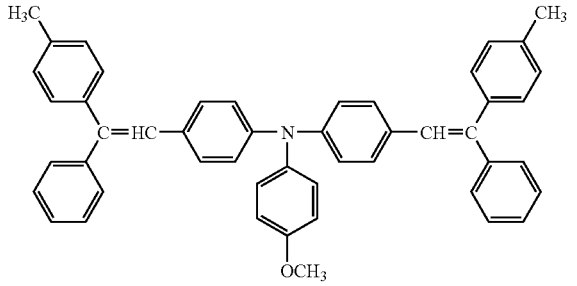

Also, two charge transport agents selected from the charge transport agents having the Structural Formulas (IXa) to (IXd) may be effectively used in combination.

The amount of the compound represented by General Formula (IX) which is incorporated into the charge transport layer is preferably 0.3 parts by mass to 2.0 parts by mass per 1 part by mass of the binder resin. When the amount is less than 0.3 parts by mass, electrical characteristics are degraded (e.g., residual potential increases); whereas when the amount is more than 2.0 parts by mass, mechanical properties (e.g., abrasion resistance) are degraded.

In addition, the compound represented by General Formula (IX) may be used in combination with other charge transport agents. In this case, the content ratio of the compound represented by General Formula (IX) to other charge transport agents is 50:50 to 95:5, preferably 70:30 to 95:5.

Examples of the other charge transport agents include high-molecular-weight conductive compounds (e.g., polyvinylcarbazole, halogenated polyvinylcarbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylenevinylene, polyisothianaphthene, polyaniline, polydiacetylene, polyheptadien, polypyridindiyl, polyquinoline, polyphenylene sulfide, polyferrocenylene, polyperinaphthylene and polyphthalocyanine) and low-molecular-weight conductive compounds (e.g., trinitrofluorenone, tetracyanoethylene, tetracyanoquinodimethane, quinone, diphenoquinone, naphthoquinone, anthraquinone, derivatives thereof, polycyclic aromatic compounds (e.g., anthracene, pyrene and phenanthrene), nitrogen-containing heterocyclic compounds (e.g., indole, carbazole and imidazole), fluorenone, fluorene, oxadiazole, oxazole, pyrazoline, hydrazone, triphenylmethane, triphenylamine, enamine and stilbene).

In addition, there can be used a polymer solid electrolyte produced by doping a polymer compound (e.g., polyethylene oxide, polypropylene oxide, polyacrylonitrile or polymethacrylic acid) with a metal ion (e.g., a Li ion).

Furthermore, there can be used a charge-transporting organic complex formed of an electron-accepting compound and an electron-donating compound (e.g., tetrathiafulvalene-tetracyanoquinodimethane). These may be used alone or in combination for imparting desired characteristics to the formed photoconductor.

Also, various additives may be added to the coating liquid for producing the electrophotographic photoconductor of the present invention so as not to impede characteristics of the formed photoconductor. Examples of the additives include antioxidants, UV ray absorbers, radical-trapping agents, softeners, hardeners and crosslinking agents. These additives can provide the photoconductor with improved characteristics, durability and mechanical properties. In particular, use of an antioxidant is advantageous since it can improve durability of the photoconductor.

Among others, an amine-based antioxidant or phenol-based antioxidant is preferably incorporated into the photosensitive layer. Examples of the amine-based antioxidant include N-phenyl-1-naphthylamine, N-phenyl-N'-isopropyl-p-phenylenediamine, N,N-diethyl-p-phenylenediamine, N-phenyl-N'-ethyl-2-methyl-p-phenylenediamine, N-ethyl-N-hydroxyethyl-p-phenylenediamine, alkylated diphenylamine, N,N'-diphenyl-p-phenylenediamine, N,N'-diallyl-p-phenylenediamine, N-phenyl-1,3-dimethylbutyl-p-phenylenediamine, 4,4'-dioctyl-diphenylamine, 4,4'-dioctyl-diphenylamine, 6-ethoxy-2,2,4-trimethyl-1,2-dihydroquinoline, 2,2,4-trimethyl-1,2-dihydroquinoline, N-phenyl-β-naphthylamine and N,N'-di-2-naphthyl-p-phenylenediamine.

Preferred examples of the phenol-based antioxidant include monophenol-based antioxidants such as 2,6-di-tert-butylphenol, 2,6-di-tert-4-methoxyphenol, 2-tert-butyl-4-methoxyphenol, 2,4-dimethyl-6-tert-butylphenol, 2,6-di-tert-butyl-4-methylphenol, butylated hydroxyanisole, stearyl β-(3,5-di-tert-butyl-4-hydroxyphenyl)propionate, α-tocopherol, β-tocopherol and n-octadecyl-3-(3'-5'-di-tert-butyl-4'-hydroxyphenyl)propionate; and polyphenol-based antioxidants such as 2,2'-methylenebis(6-tert-butyl-4-methylphenol), 4,4'-butylidene-bis-(3-methyl-6-tert-butylphenol), 4,4'-thiobis-(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl)benzene and tetrakis(methylene-3-(3,5-di-tert-butyl-4-hydroxyphenyl)propionate)methane. These antioxidants may be used alone or in combination in the photosensitive layer.

Preferred examples of the UV ray absorber include benzotriazole-based UV ray absorbers such as 2-(5-methyl-2-hydroxyphenyl)benzotriazole, 2-(2-hydroxy-3,5-bis(α,α-dimethylbenzyl)phenyl)-2H-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole and 2-(2'-hydroxy-5'-tert-octylphenyl)benzotriazole; and salicylic acid-based UV ray absorbers such as phenyl salicylate, p-tert-butylphenyl salicylate and p-octylphenyl salicylate, with benzotriazole-based UV ray absorbers being particularly preferred. These UV ray absorbers may be used alone or in combination in the photosensitive layer.

The amount of the amine-based antioxidant which may be incorporated into the electrophotographic photoconductor of the present invention is preferably 3% by mass to 20% by mass with respect to the binder resin. The amount of the UV ray absorber which may be incorporated into the electrophotographic photoconductor of the present invention is preferably 3% by mass to 30% by mass with respect to the binder resin.

Optionally, as a surface protective layer on the photosensitive layer, an organic thin film is formed of, for example, polyvinyl formal resin, polycarbonate resin, fluorine resin, polyurethane resin or silicone resin; or a thin film with a siloxane structure is formed by hydrolyzing a silane coupling agent. Provision of the surface protective layer is preferred from the viewpoint of increasing durability of the photoconductor. Also, the surface protective layer may be provided for the purpose of increasing other performances than durability. The thickness of the protective layer is preferably 0.1 μm to 20 μm.

An electrophotographic apparatus to which the electrophotographic photoconductor of the present invention is to be mounted includes generally used units such as a charging unit, exposing unit and transfer unit. Specifically, the charging unit may employ any of contact charging with a brush or roller and non-contact charging with a scorotron or corotron, and also employ any of positive charging and negative charging. The exposing unit may employ an LED, LD, etc. The developing unit may employ a one-/two-component, magnetic/non-magnetic developing agent. The transfer unit may employ a roller, belt, etc. The cleaning unit may employ blade cleaning or brush cleaning. The charging or developing unit may also have a function of the cleaning unit. Alternatively, an electrophotographic apparatus having no cleaning unit or charge-eliminating unit may be used.

Figure 2:
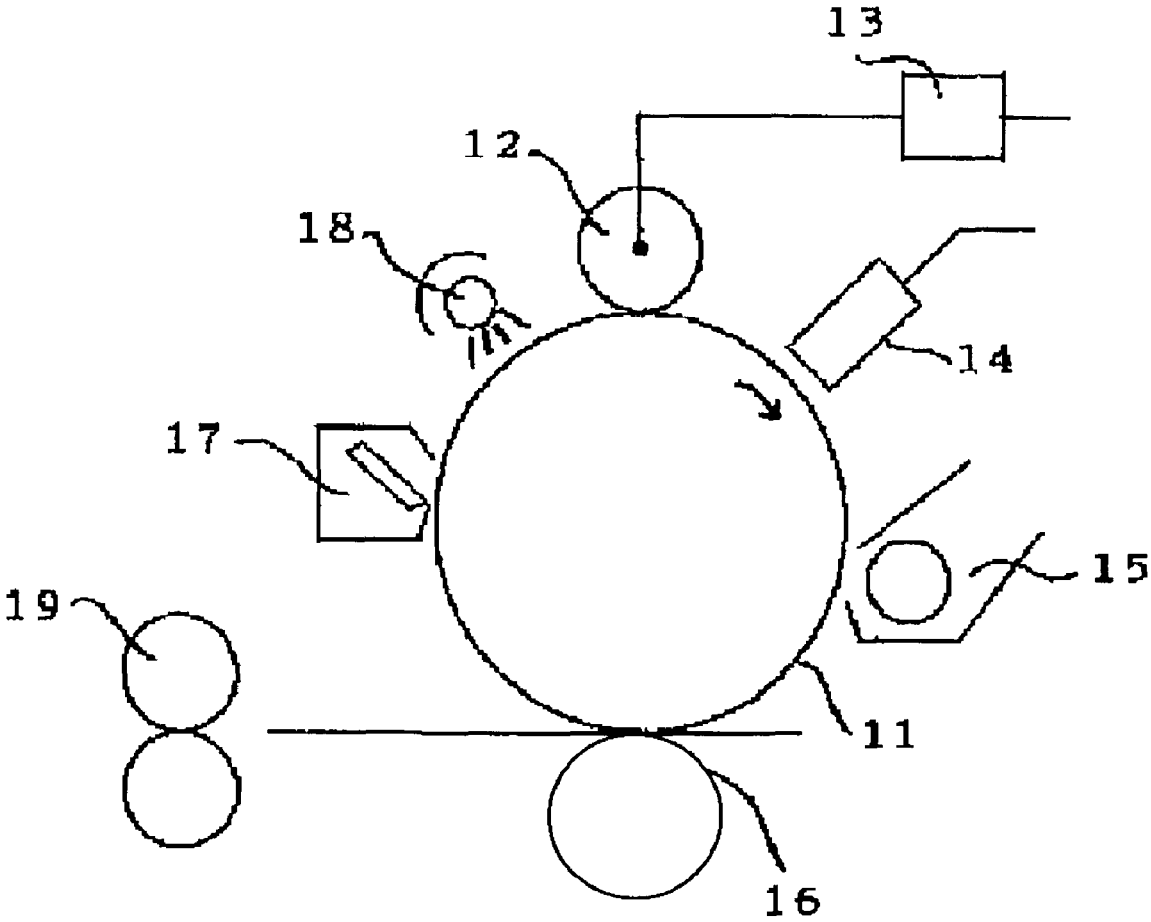
FIG. 2 illustrates a schematic configuration of an electrophotographic photoconductor of the present invention.

Next will be described an electrophotographic apparatus of the present invention. FIG. 2 is a schematic view of an electrophotographic apparatus of the present invention. In FIG. 2, around a photoconductor (11) are provided a charging member (12), an exposing device (14), a developing device (15), a transfer device (16), a cleaning device (17), a charge-eliminating device (18) and a fixing device (19), wherein the charging member (12) is provided so as to be in contact with the photoconductor (11). Also, voltage is applied to the charging member (12) from a power source (13).

EXAMPLES

Next will be described in detail an electrophotographic photoconductor of the present invention by way of Examples and Comparative Examples.

Example 1

An alkyl resin (BECKOLITE M-6401-50, product of Dainippon Ink and Chemicals, Inc.) and an amino resin (SUPER BECKAMINE G-821-60, product of Dainippon Ink and Chemicals, Inc.) were mixed each other at a ratio of 65:35. The resultant resin mixture and titanium oxide (CR-EL, product of ISHIHARA SANGYO KAISHA, LTD.) in a ratio of 1:3 were dissolved in methyl ethyl ketone to prepare a coating solution. The thus-prepared coating solution was applied onto a cylindrical aluminum drum having undergone no surface lathing (diameter: 30 mm) to a thickness of 1.5 μm, to thereby form an undercoat layer.

Subsequently, a polyvinyl butyral resin (BH-5, product of SEKISUI CHEMICAL CO., LTD.) (10 g) was dissolved in methyl ethyl ketone (500 mL). Thereafter, a disazo pigment with the following Structural Formula (Ia) (30 g, in powder form) and glass beads were added to the above-prepared solution, followed by dispersing for 20 hours with a sand mill disperser. The thus-obtained dispersion was filtrated for removing glass beads to prepare a coating liquid for forming a charge generation layer. This coating liquid was applied onto the above-formed undercoat layer through dip coating, followed by drying, to thereby form a charge generation layer with a thickness of 0.2 μm.

Structural Formula (Ia)

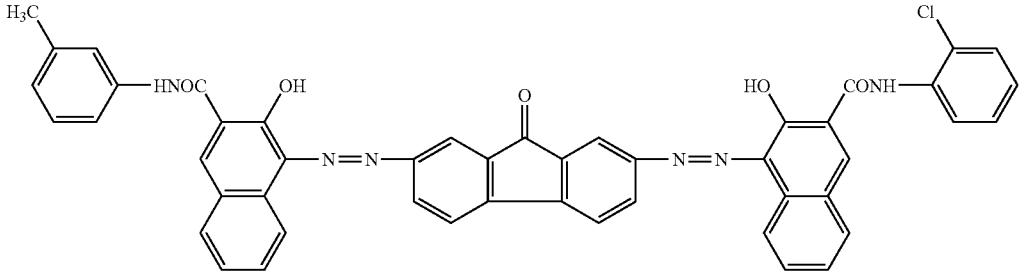

Subsequently, a polycarbonate resin (binder resin, Z500 (product of MITSUBISHI GAS CHEMICAL COMPANY, INC.)), a compound having the Structural Formula (IXa) (charge transport agent), N-phenyl-1-naphthylamine (aromatic amine-based antioxidant) and 2-(5-methyl-2-hydroxyphenyl)benzotriazole (UV ray absorber) in a proportion by mass of 1.0:1.0:0.05:0.05 were dissolved in chloroform to prepare a coating liquid for forming a charge transport layer. The thus-prepared coating liquid was applied onto the charge generation layer through dip coating, followed by drying at 120° C. for 60 min, to thereby form a charge transport layer with a thickness of 25.0 μm. Through the above procedure, an electrophotographic photoconductor was produced.

Example 2

The procedure of Example 1 was repeated, except that the charge transport agent was changed to a charge transport agent having the Structural Formula (IXb), to thereby produce an electrophotographic photoconductor.

Example 3

The procedure of Example 1 was repeated, except that the charge transport agent was changed to a charge transport agent having the Structural Formula (IXc), to thereby produce an electrophotographic photoconductor.

Example 4

The procedure of Example 1 was repeated, except that the charge transport agent was changed to a charge transport agent having the Structural Formula (IXd), to thereby produce an electrophotographic photoconductor.

Example 5

The procedure of Example 1 was repeated, except that the charge transport agent was changed to a charge transport agent which had been prepared by mixing the charge transport agent having the Structural Formula (IXa) and the charge transport agent having the Structural Formula (IXb) at a mixing ratio of 0.8:0.2, to thereby produce an electrophotographic photoconductor.

Example 6

The procedure of Example 1 was repeated, except that the is charge transport agent was changed to a charge transport agent which had been prepared by mixing the charge transport agent having the Structural Formula (IXa) and the charge transport agent having the Structural Formula (IXb) at a mixing ratio of 0.5:0.5, to thereby produce an electrophotographic photoconductor.

Example 7

The procedure of Example 1 was repeated, except that the charge transport agent was changed to a charge transport agent which had been prepared by mixing the charge transport agent having the Structural Formula (IXc) and the charge transport agent having the Structural Formula (IXd) at a mixing ratio of 0.8:0.2, to thereby produce an electrophotographic photoconductor.

Example 8

The procedure of Example 1 was repeated, except that the charge transport agent was changed to a charge transport agent which had been prepared by mixing the charge transport agent having the Structural Formula (IXc) and the charge transport agent having the Structural Formula (IXd) at a mixing ratio of 0.5:0.5, to thereby produce an electrophotographic photoconductor.

Example 9

The procedure of Example 1 was repeated, except that the disazo pigment was changed to a disazo pigment having the following Structural Formula (Ib), to thereby produce an electrophotographic photoconductor.

Structural Formula (Ib)

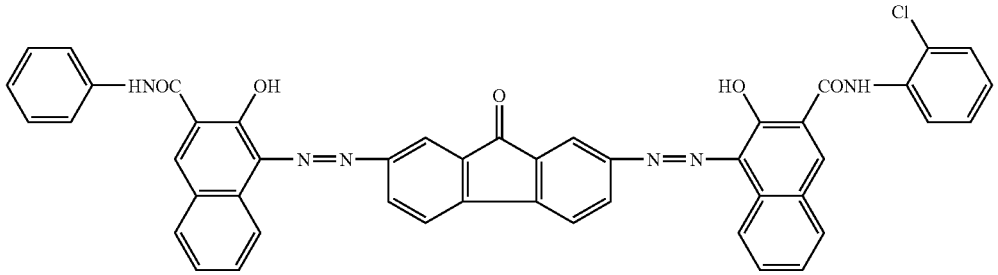

Example 10

The procedure of Example 1 was repeated, except that the disazo pigment was changed to a disazo pigment having the following Structural Formula (Ic), to thereby produce an electrophotographic photoconductor.

Structural Formula (Ic)

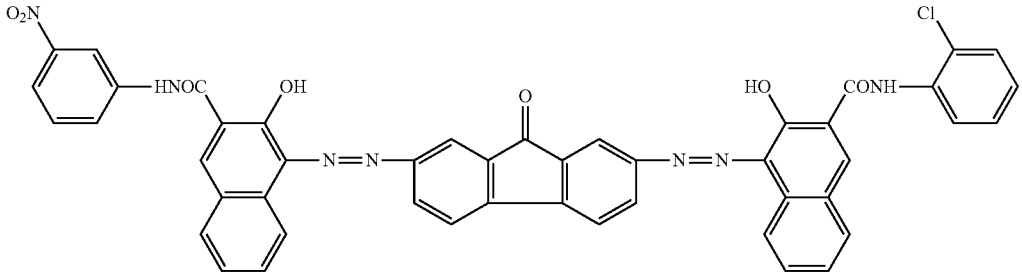

Example 11

The procedure of Example 1 was repeated, except that no N-phenyl-1-naphthylamine (aromatic amine-based antioxidant) was used, to thereby produce an electrophotographic photoconductor.

Example 12

The procedure of Example 1 was repeated, except that the proportion by mass of a polycarbonate resin (Z500, product of MITSUBISHI GAS CHEMICAL COMPANY, INC.), a compound having the Structural Formula (IXa) (charge transport agent), N-phenyl-1-naphthylamine (aromatic amine-based antioxidant) and 2-(5-methyl-2-hydroxyphenyl)benzotriazole (UV ray absorber) was changed to 1.0:0.3:0.015:0.015, to thereby produce an electrophotographic photoconductor.

Example 13

The procedure of Example 1 was repeated, except that the proportion by mass of a polycarbonate resin (Z500, product of MITSUBISHI GAS CHEMICAL COMPANY, INC.), a compound having the Structural Formula (IXa) (charge transport agent), N-phenyl-1-naphthylamine (aromatic amine-based antioxidant) and 2-(5-methyl-2-hydroxyphenyl)benzotriazole (UV ray absorber) was changed to 1.0:2.0:0.10:0.10, to thereby produce an electrophotographic photoconductor.

Comparative Example 1

The procedure of Example 1 was repeated, except that the charge generation agent was changed to a disazo pigment having the following Structural Formula (A), to thereby produce an electrophotographic photoconductor.

Structural Formula (A)

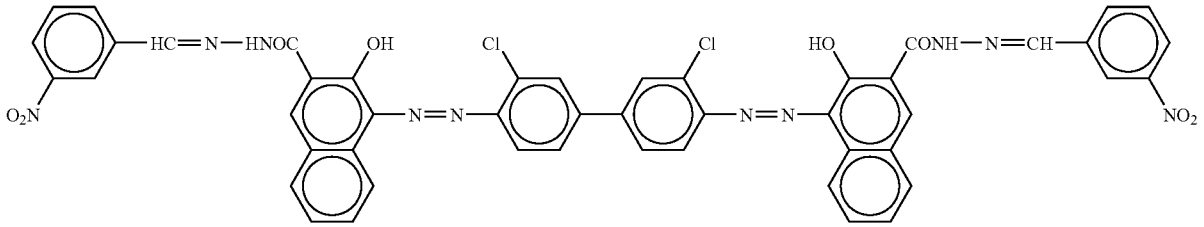

Comparative Example 2

Figure 3:
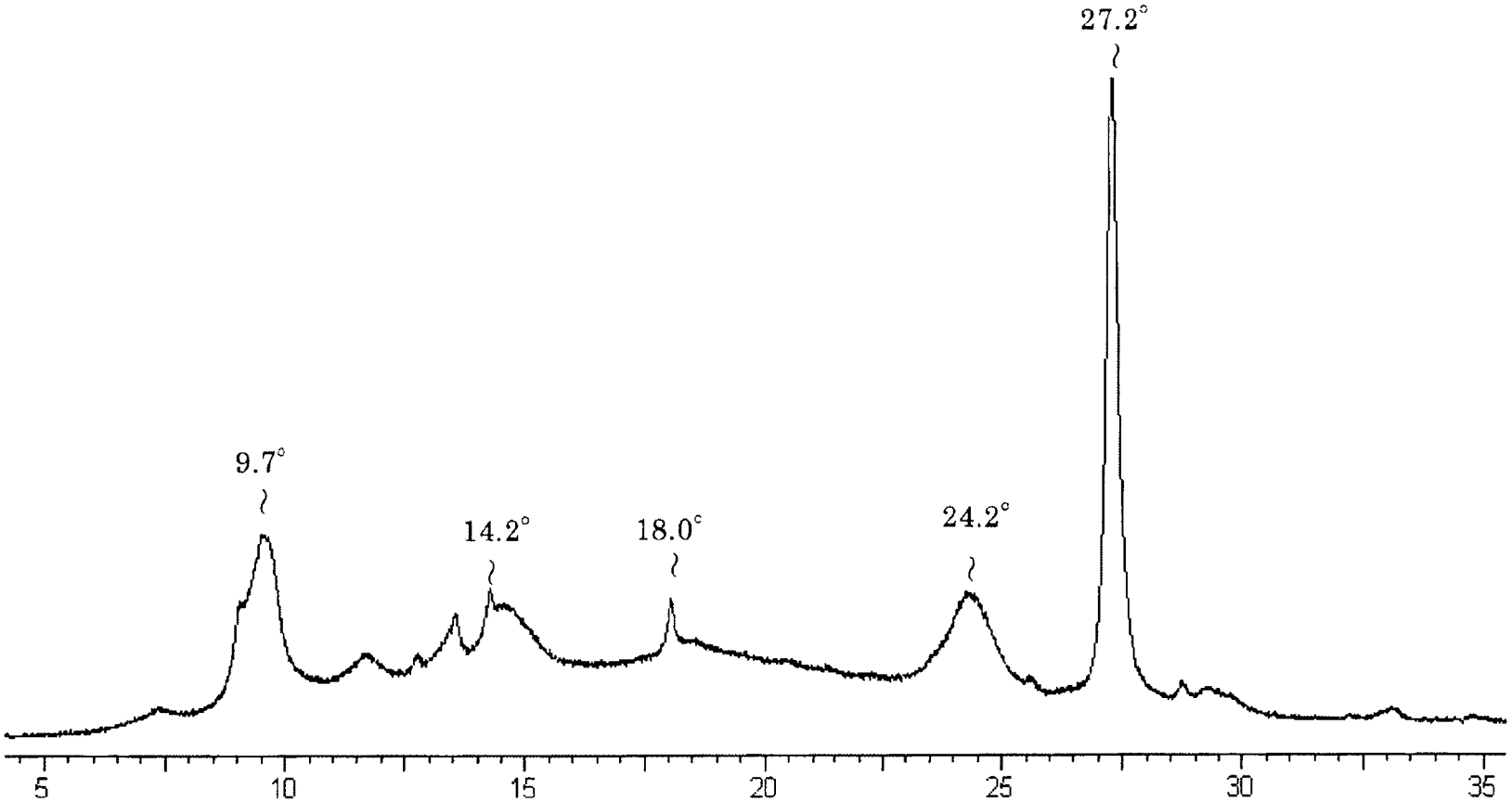
FIG. 3 is an X-ray diffraction diagram of Y-type oxytitanium phthalocyanine used in Comparative Example 2.

The procedure of Example 1 was repeated, except that the charge generation agent was changed to Y-type oxytitanium phthalocyanine with a maximum peak at a Bragg angle 2θ of 27.2°±0.2° in an X-ray diffraction spectrum (FIG. 3), to thereby produce an electrophotographic photoconductor.

Comparative Example 3

The procedure of Example 1 was repeated, except that the charge transport agent was changed to a charge transport agent having the following Structural Formula (B), to thereby produce an electrophotographic photoconductor.

Structural Formula (B)

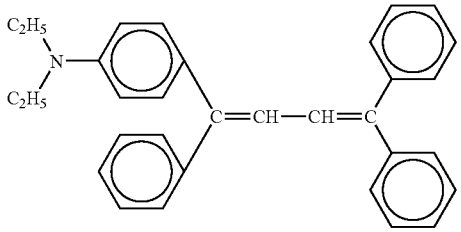

Comparative Example 4

The procedure of Example 1 was repeated, except that the charge transport agent was changed to a charge transport agent having the following Structural Formula (C), to thereby produce an electrophotographic photoconductor.

Structural Formula (C)

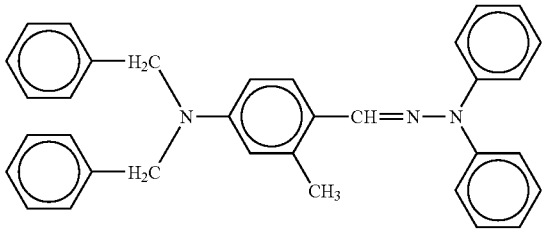

Comparative Example 5

The procedure of Example 1 was repeated, except that the charge transport agent was changed to a charge transport agent having the following Structural Formula (D), to thereby produce an electrophotographic photoconductor.

Structural Formula (D)

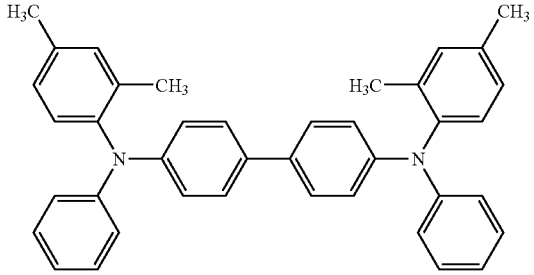

Comparative Example 6

The procedure of Example 1 was repeated, except that the proportion by mass of a polycarbonate resin (Z500, product of MITSUBISHI GAS CHEMICAL COMPANY, INC.), a compound having the Structural Formula (IXa) (charge transport agent), N-phenyl-1-naphthylamine (aromatic amine-based antioxidant) and 2-(5-methyl-2-hydroxyphenyl)benzotriazole (UV ray absorber) was changed to 1.0:0.2:0.01:0.01, to thereby produce an electrophotographic photoconductor.

Comparative Example 7

The procedure of Example 1 was repeated, except that the proportion by mass of a polycarbonate resin (Z500, product of MITSUBISHI GAS CHEMICAL COMPANY, INC.), a compound having the Structural Formula (IXa) (charge transport agent), N-phenyl-1-naphthylamine (aromatic amine-based antioxidant) and 2-(5-methyl-2-hydroxyphenyl)benzotriazole (UV ray absorber) was changed to 1.0:2.5:0.125:0.125, to thereby produce an electrophotographic photoconductor.

Evaluation for Photoconductor

<Evaluation of Electrical Characteristics Using Simplified Measuring Device>

Each of the functionally separated photoconductors produced in Examples 1 to 13 and Comparative Examples 1 to 7 was evaluated for its electrophotographic characteristics with a photoconductor drum evaluation device (dynamic mode) as described below.

The evaluation was carried out with an electrophotographic photoconductor evaluation device (product of Yamanashi Electronics Co., Ltd.). Specifically, each of the photoconductors produced in Examples and Comparative Examples was charged to a surface potential of −700V with a scorotron at a temperature/humidity of 23° C./50%. The charged photoconductor was irradiated with light having a wavelength of 650 nm using a laser diode at such an exposure dose that the surface potential thereof was adjusted to −350V (½). Note that the residual potential after light exposure at an exposure dose of 1.0 μJ/cm$^2$ was regarded as the residual potential (VL) of a photoconductor.

The electrophotographic photoconductor was subjected to 10,000 cycles each including charging, light exposing and charge eliminating, and was measured for its surface potential (V0), surface potential (VH) and residual potential (VL) after the 1st and 10,000th cycles. Charge elimination was performed using an LED with a wavelength being 660 nm (20 μW). The electrophotographic photoconductor rotated at 150 rpm and it took 0.06 sec to reach a measurement point from a laser irradiation point. The results are shown in Table 2.

<Evaluation for Printed Image>

<Evaluation of Color Density>

In an ambient environment (temperature: 23° C. and humidity: 50%), halftone (grey background) images and solid (black background) images were printed out using a color copier (IPSIO CX655, product of Ricoh Company, Ltd.) in which each of the electrophotographic photoconductors produced in Examples 1 to 13 and Comparative Examples 1 to 7 had been mounted. The 1st and the 10,000th printed halftone and solid images were measured for their image density with a Macbeth densitometer. In the density of halftone images, a value of 0.6 to 0.7 was set to a reference value. In the density of solid images, a value of 1.3 to 1.4 was set to a reference value. Note that the lower each of the values, the lower each of the image densities. The results are shown in Table 3.

<Evaluation of Memory>

In an ambient environment (temperature: 23° C. and humidity: 50%), images were printed out using a color copier (IPSIO CX400, product of Ricoh Company, Ltd.) in which each of the electrophotographic photoconductors produced in Examples 1 to 13 and Comparative Examples 1 to 7 had been mounted. The 1st and the 10,000th printed images were visually observed and evaluated for their memory (residual image) according to the following ranks:

5: No memory observed,

4: Rank 3<degree of memory<Rank 5

3: Memory slightly observed,

2: Rank 1<degree of memory<Rank 3, and

1: Memory clearly observed. The results are shown in Table 3.

TABLE 2

| | Initial potential | | | Potential after 10,000 cycles | | |
|---|---|---|---|---|---|---|
| | V0 (V) | VH (μj/cm$^2$) | VL (V) | V0 (V) | VH (μj/cm$^2$) | VL (V) |
| Ex. 1 | 600 | 0.12 | 25 | 605 | 0.13 | 27 |
| Ex. 2 | 600 | 0.12 | 26 | 603 | 0.11 | 28 |
| Ex. 3 | 605 | 0.14 | 25 | 602 | 0.13 | 27 |
| Ex. 4 | 605 | 0.15 | 30 | 600 | 0.14 | 32 |
| Ex. 5 | 600 | 0.13 | 26 | 605 | 0.14 | 28 |
| Ex. 6 | 600 | 0.13 | 27 | 606 | 0.14 | 29 |
| Ex. 7 | 605 | 0.16 | 27 | 605 | 0.17 | 30 |
| Ex. 8 | 605 | 0.16 | 30 | 608 | 0.17 | 33 |
| Ex. 9 | 605 | 0.16 | 30 | 604 | 0.17 | 32 |
| Ex. 10 | 605 | 0.17 | 30 | 600 | 0.17 | 32 |
| Ex. 11 | 600 | 0.12 | 25 | 565 | 0.12 | 23 |
| Ex. 12 | 610 | 0.14 | 35 | 615 | 0.16 | 40 |
| Ex. 13 | 595 | 0.11 | 25 | 560 | 0.11 | 22 |
| Comp. Ex. 1 | 600 | 0.29 | 25 | 595 | 0.33 | 27 |
| Comp. Ex. 2 | 605 | 0.13 | 31 | 605 | 0.12 | 24 |
| Comp. Ex. 3 | 605 | 0.14 | 100 | 600 | 0.16 | 150 |
| Comp. Ex. 4 | 600 | 0.16 | 110 | 595 | 0.18 | 160 |
| Comp. Ex. 5 | 600 | 0.15 | 98 | 595 | 0.17 | 90 |
| Comp. Ex. 6 | 620 | 0.16 | 58 | 625 | 0.18 | 85 |
| Comp. Ex. 7 | 580 | 0.11 | 25 | 570 | 0.11 | 20 |

TABLE 3

| | Initial image characteristics | | | Image characteristics after 10,000 cycles | | |
|---|---|---|---|---|---|---|
| | Half-tone | Solid | Memory | Halftone | Solid | Memory |
| Ex. 1 | 0.8 | 1.4 | 5 | 0.8 | 1.4 | 5 |
| Ex. 2 | 0.8 | 1.4 | 5 | 0.8 | 1.4 | 5 |
| Ex. 3 | 0.8 | 1.4 | 5 | 0.8 | 1.4 | 5 |
| Ex. 4 | 0.8 | 1.4 | 5 | 0.8 | 1.4 | 5 |
| Ex. 5 | 0.8 | 1.4 | 5 | 0.8 | 1.4 | 5 |
| Ex. 6 | 0.8 | 1.4 | 5 | 0.8 | 1.4 | 5 |
| Ex. 7 | 0.8 | 1.4 | 5 | 0.8 | 1.4 | 5 |
| Ex. 8 | 0.8 | 1.4 | 5 | 0.8 | 1.4 | 5 |
| Ex. 9 | 0.8 | 1.4 | 5 | 0.8 | 1.4 | 5 |
| Ex. 10 | 0.8 | 1.4 | 5 | 0.8 | 1.4 | 5 |
| Ex. 11 | 0.8 | 1.4 | 5 | 0.8 | 1.4 | 5 |
| Ex. 12 | 0.8 | 1.3 | 5 | 0.8 | 1.3 | 5 |
| Ex. 13 | 0.8 | 1.4 | 5 | 0.8 | 1.4 | 5 |
| Comp. Ex. 1 | 0.3 | 1.4 | 5 | 0.3 | 1.4 | 5 |

TABLE 3-continued

| | Initial image characteristics | | | Image characteristics after 10,000 cycles | | |
|---|---|---|---|---|---|---|
| | Half-tone | Solid | Memory | Halftone | Solid | Memory |
| Comp. Ex. 2 | 0.8 | 1.4 | 2 | 0.8 | 1.4 | 1 |
| Comp. Ex. 3 | 0.8 | 1.1 | 5 | 0.7 | 1.0 | 4 |
| Comp. Ex. 4 | 0.8 | 1.1 | 5 | 0.7 | 1.0 | 4 |
| Comp. Ex. 5 | 0.8 | 1.1 | 5 | 0.7 | 0.9 | 4 |
| Comp. Ex. 6 | 0.7 | 1.1 | 5 | 0.6 | 1.0 | 5 |
| Comp. Ex. 7 | 0.8 | 1.4 | 5 | Scratched | Scratched | 2 |

As is clear from Tables 2 and 3, in the electrophotographic photoconductors of Examples 1 to 13, containing the charge generation agent and the charge transport agent in the present invention, a change in VH was found to be small between initial surface potential (surface potential obtained at ½ exposure dose) and residual potential (charge potential after 10,000 cycles). Similarly, a change in residual potential was found to be small. These results indicate that the electrophotographic photoconductors of Examples 1 to 13 have excellent characteristics as a photoconductor. Also, the electrophotographic photoconductors of Examples 1 to 10 and 12, further containing the aromatic amine-based antioxidant, were found to be highly resistant to repetitive cycles (10,000 cycles) since a drop in surface potential (V0) was up to 5V. The electrophotographic photoconductor of Example 10 was found to exhibit insufficient sensitivity, but to be applicable to practical use since no problem arose in terms of image density. Further, in the electrophotographic photoconductors of Examples 11 and 13, the surface potential (V0) was found to somewhat drop, but to be applicable to practical use since a change in residual potential (VL) was not large.

In contrast, the electrophotographic photoconductor of Comparative Example 1 was found to exhibit insufficient sensitivity and provide a halftone image having decreased density. The electrophotographic photoconductor of Comparative Example 2 was found to cause image memory. The electrophotographic photoconductors of Comparative Examples 3 to 5 were found to exhibit high residual potential, to provide an image having insufficient density, and to involve considerable image memory after 10,000 cycles. The electrophotographic photoconductor of Comparative Example 6 was found to exhibit high residual potential and charge potential and to provide an image having decreased density. The electrophotographic photoconductor of Comparative Example 7 was found to suffer from scratches due to reduction in film strength, resulting in providing a scratched image.

What is claimed is:

1. An electrophotographic photoconductor comprising:

a conductive support, and a photosensitive layer formed over the conductive support, wherein the photosensitive layer comprises a charge generation agent, a charge transport agent and a binder resin, and wherein the charge generation agent comprises an asymmetric disazo pigment represented by the following General Formula (I), the charge transport agent comprises a triphenylamine compound represented by the following General Formula (IX), and the ratio by mass of the charge transport agent to the binder resin is 0.3 to 2.0, General Formula (I)

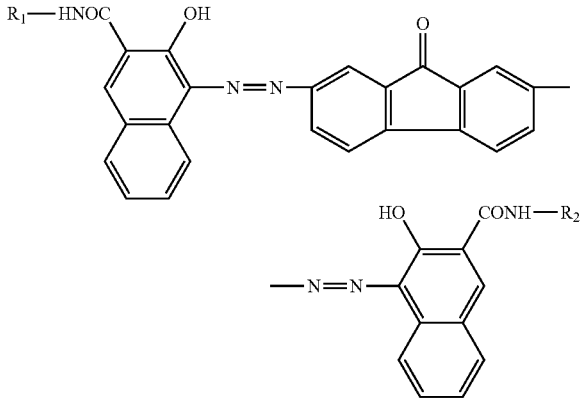

where $R_1$ and $R_2$ each represent a substituted or unsubstituted alkyl group, alkoxy group, aryl group or heterocyclic group, provided that $R_1$ and $R_2$ are different, General Formula (IX)

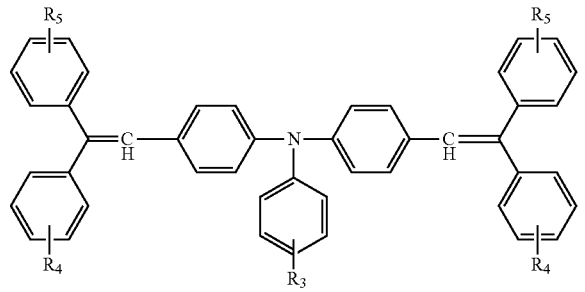

where $R_3$ to $R_5$ each represent hydrogen, a halogen atom, an alkyl group having 1 to 6 carbon atoms, which may have a substituent, an alkoxy group having 1 to 6 carbon atoms, which may have a substituent, or a substituted or unsubstituted aryl group having 6 to 12 carbon atoms.

2. The electrophotographic photoconductor according to claim 1, wherein the charge transport agent comprises a compound having the following Structural Formula (IXa)

Structural Formula (IXa)

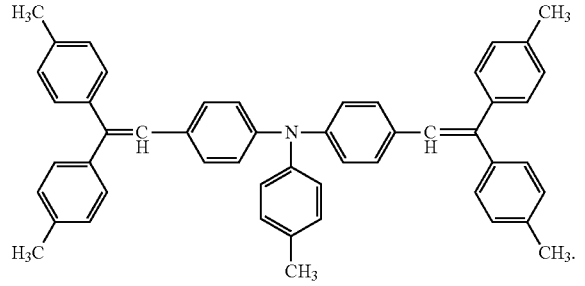

3. The electrophotographic photoconductor according to claim 2, wherein the charge generation agent comprises an asymmetric disazo pigment having the following Structural Formula (Ia)

Structural Formula (Ia)

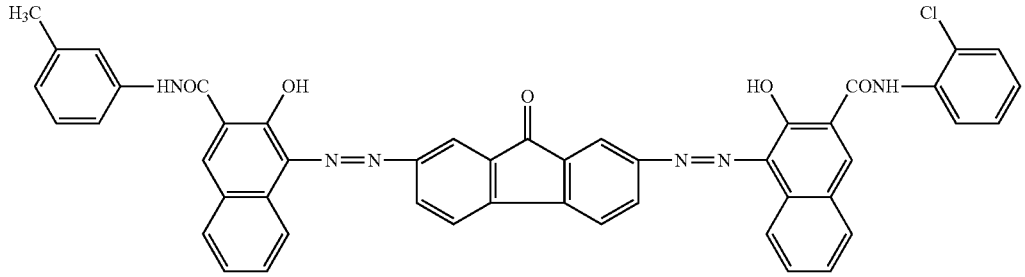

4. The electrophotographic photoconductor according to claim 1, wherein the charge transport agent comprises a compound having the following Structural Formula (IXb)

Structural Formula (IXb)

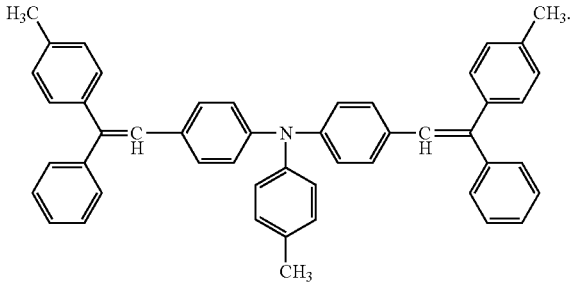

5. The electrophotographic photoconductor according to claim 1, wherein the charge transport agent comprises a compound having the following Structural Formula (IXc)

Structural Formula (IXc)

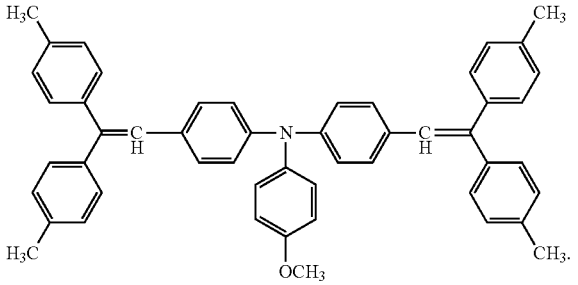

6. The electrophotographic photoconductor according to claim 1, wherein the charge transport agent comprises a compound having the following Structural Formula (IXd)

Structural Formula (IXd)

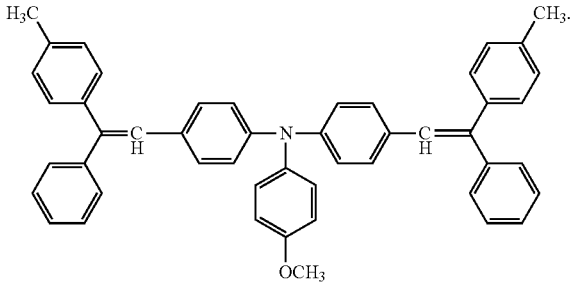

7. The electrophotographic photoconductor according to claim 1, wherein the electrophotographic photoconductor comprises two charge transport agents selected from a charge transport agent having the Structural Formula (IXa), a charge transport agent having the Structural Formula (IXb), a charge transport agent having the Structural Formula (IXc) and a charge transport agent having the Structural Formula (IXd)

Structural Formula (IXa)

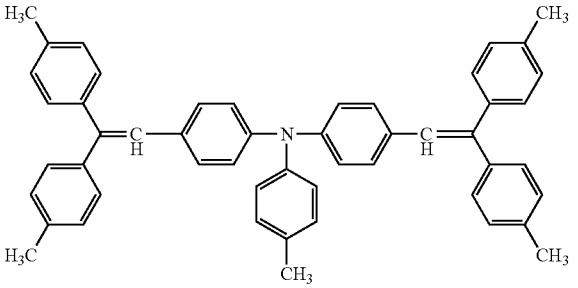

Structural Formula (IXb)

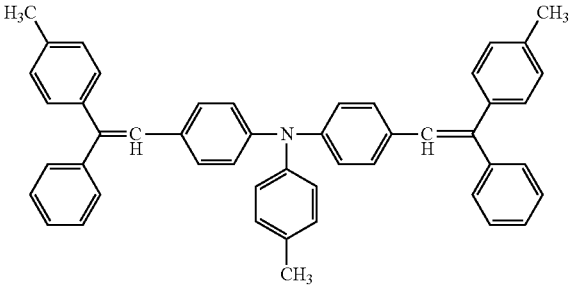

Structural Formula (IXc)

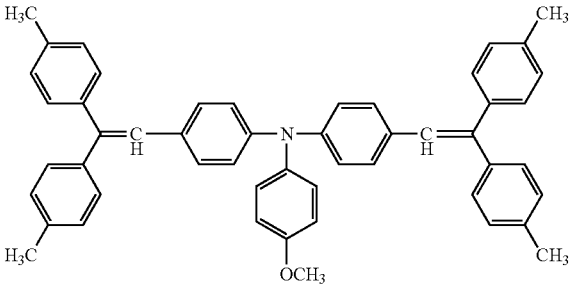

-continued

Structural Formula (IXd)

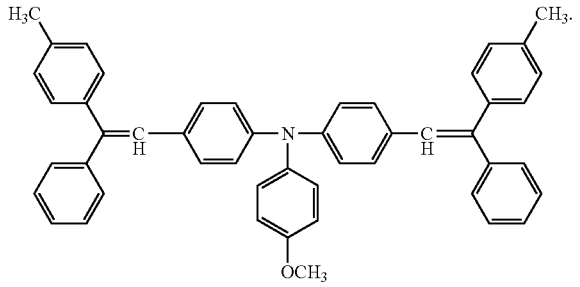

General Formula (IX)

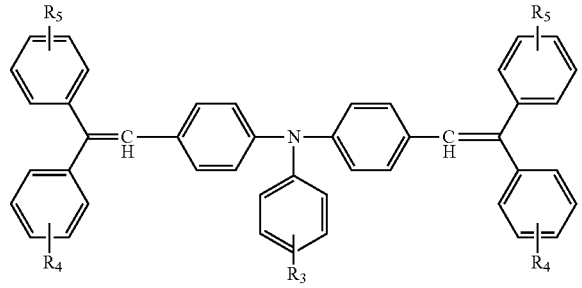

8. The electrophotographic photoconductor according to claim 1, wherein the photosensitive layer comprises a charge generation layer and a charge transport layer.

9. The electrophotographic photoconductor according to claim 1, wherein the charge transport layer comprises a benzotriazole-based UV ray absorber.

10. The electrophotographic photoconductor according to claim 9, wherein the amount of benzotriazole-based UV ray absorber is 3% to 30% by mass with respect to the binder resin.

11. The electrophotographic photoconductor according to claim 1, wherein the charge transport layer comprises an amine-based antioxidant.

12. An electrophotographic apparatus comprising:

a charging unit, an exposing unit, a developing unit, a transfer unit, and an electrophotographic photoconductor, wherein the electrophotographic photoconductor comprises a conductive support, and a photosensitive layer formed over the conductive support, wherein the photosensitive layer comprises a charge generation agent, a charge transport agent and a binder resin, and wherein the charge generation agent comprises an asymmetric disazo pigment represented by the following General Formula (I), the charge transport agent comprises a triphenylamine compound represented by the following General Formula (IX), and the ratio by mass of the charge transport agent to the binder resin is 0.3 to 2.0, where $R_3$ to $R_5$ each represent hydrogen, a halogen atom, an alkyl group having 1 to 6 carbon atoms, which may have a substituent, an alkoxy group having 1 to 6 carbon atoms, which may have a substituent, or a substituted or unsubstituted aryl group having 6 to 12 carbon atoms.

13. The electrophotographic apparatus according to claim 12, wherein the electrophotographic apparatus is a digital electrophotographic apparatus in which an electrostatic latent image is written on the electrophotographic photoconductor using an LD or LED as the exposing unit.

14. The electrophotographic apparatus according to claim 12, wherein the electrophotographic apparatus is a tandem electrophotographic apparatus including a plurality of electrophotographic photoconductors, charging units, developing units and transfer units.

15. The electrophotographic apparatus according to claim 12, further comprising an intermediate transfer unit configured to primarily transfer a toner image developed on the electrophotographic photoconductor onto an intermediate transfer member and secondarily transfer the toner image onto a recording medium, wherein toner images of a plurality of colors are sequentially superimposed on the intermediate transfer member to form a color image and then the color image is secondarily transferred at one time onto the recording medium.

16. An electrophotographic process cartridge comprising:

at least one of a charging unit, an exposing unit, a developing unit, a cleaning unit and a transfer unit, and an electrophotographic photoconductor, wherein the electrophotographic photoconductor comprises a conductive support, and a photosensitive layer formed over the conductive support, wherein the photosensitive layer contains a charge generation agent, a charge transport agent and a binder resin, and General Formula (I)

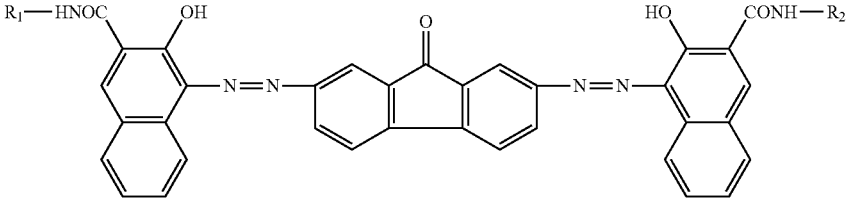

where $R_1$ and $R_2$ each represent a substituted or unsubstituted alkyl group, alkoxy group, aryl group or heterocyclic group, provided that $R_1$ and $R_2$ are different, wherein the charge generation agent comprises an asymmetric disazo pigment represented by the following General Formula (I), the charge transport agent comprises a triphenylamine compound represented by the following General Formula (IX), and the ratio by mass of the charge transport agent to the binder resin is 0.3 to 2.0, General Formula (I)

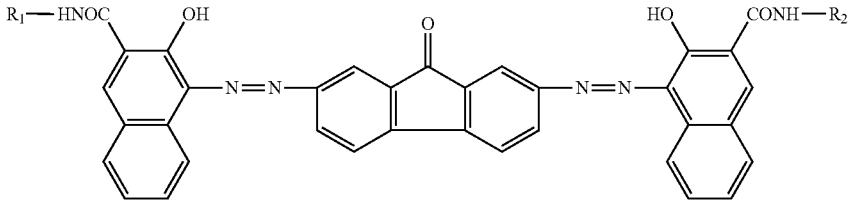

where $R_1$ and $R_2$ each represent a substituted or unsubstituted alkyl group, alkoxy group, aryl group or heterocyclic group, provided that $R_1$ and $R_2$ are different, General Formula (IX)

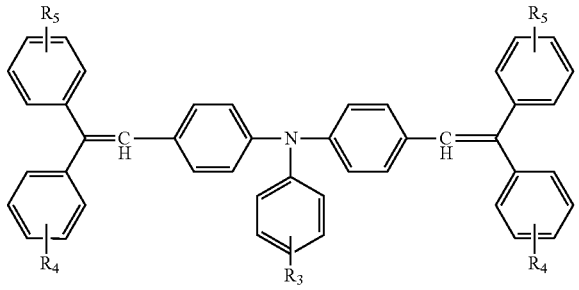

where $R_3$ to $R_5$ each represent hydrogen, a halogen atom, an alkyl group having 1 to 6 carbon atoms, which may have a substituent, an alkoxy group having 1 to 6 carbon atoms, which may have a substituent, or a substituted or unsubstituted aryl group having 6 to 12 carbon atoms.

* * * * *